US005978631A

United States Patent [19]

Lee

[11] Patent Number: 5,978,631

[45] Date of Patent: Nov. 2, 1999

[54] LIQUID ELECTROPHOTOGRAPHIC PRINTER AND IMPROVED DRYING UNIT

[75] Inventor: Beom-ro Lee, Seoul, Rep. of Korea

[73] Assignee: Samsung Electronics Co., Ltd., Kyungki-do, Rep. of Korea

[21] Appl. No.: 09/088,486

[22] Filed: Jun. 2, 1998

[30] Foreign Application Priority Data

Jun. 30, 1997 [KR] Rep. of Korea ..... 97-16682

[51] Int. Cl.[6] ..... G03G 15/10

[52] U.S. Cl. ..... 399/251; 399/249

[58] Field of Search ..... 399/249, 250, 399/251, 233, 296, 92, 96; 210/770, 768, 180; 261/DIG. 32, 30

[56] References Cited

U.S. PATENT DOCUMENTS

| | | | |
|---|---|---|---|
| 4,659,206 | 4/1987 | Kai et al. | 399/96 |
| 4,796,048 | 1/1989 | Bean | 399/249 X |
| 5,552,869 | 9/1996 | Schilli et al. | 399/251 |
| 5,557,377 | 9/1996 | Loewen et al. | 399/249 X |
| 5,640,655 | 6/1997 | Shoji | 399/249 |

FOREIGN PATENT DOCUMENTS 05-224540 9/1993 Japan .

*Primary Examiner*—Matthew S. Smith
*Assistant Examiner*—Sophia S. Chen
*Attorney, Agent, or Firm*—Sughrue, Mion, Zinn, Macpeak & Seas, PLLC

[57] ABSTRACT

A liquid electrophotographic printer having an improved drying unit is provided. The liquid electrophotographic printer includes a photoreceptor belt circulating and supported by a plurality of rollers on an endless track, for forming a latent electrostatic image on the photoreceptor belt, a development unit for supplying a developer liquid to the photoreceptor belt and developing the latent electrostatic image into a toner image, a drying unit for drying the photoreceptor belt on which the toner image is formed, and a transfer unit for transferring the toner image to a sheet of paper, wherein the drying unit includes a heating device installed in the vicinity of one surface of the photoreceptor belt for heating the photoreceptor belt on which the toner image is formed to evaporate a carrier sticking to the photoreceptor belt, and a collector installed in the vicinity of another surface of the photoreceptor belt for collecting the carrier evaporated by the heating device. Therefore, the drying unit is simplified, and the life of the photoreceptor belt is prolonged. Also, a slip of the photoreceptor belt is prevented.

9 Claims, 4 Drawing Sheets

LIQUID ELECTROPHOTOGRAPHIC PRINTER AND IMPROVED DRYING UNIT

BACKGROUND OF THE INVENTION

1. Field of the Invention

The present invention relates to a liquid electrophotographic printer, and more particularly, to a liquid electrophotographic printer having an improved drying device for drying a photoreceptor belt.

2. Description of the Related Art

An electrophotographic printer such as a laser printer generally employs a mechanism for supplying a developer having a predetermined color to a photosensitive medium, such as a photoreceptor drum or a photoreceptor belt, on which a latent electrostatic image is formed, and developing the latent electrostatic image into a toner image.

The developer is divided into either a liquid type developer or a powder type developer. The liquid type developer has a fine particle toner having a predetermined color dispersed in a volatile liquid carrier. The liquid laser printer using a liquid type developer has a better printing quality than the dry laser printer using only a powder toner, and can be protected from harmful toner powder. Therefore, the liquid type developer is being increasingly used.

Referring to FIG. 1, a conventional image developing apparatus includes a photoreceptor belt 110 on an endless track, and first, second and third rollers 121, 122 and 123 for circulating the photoreceptor belt 110 along the endless track. The third roller 123 is a driving roller driven by a driving motor (not shown) for rotating the photoreceptor belt 110, and the second roller 122 is a steering roller for preventing meandering by adjusting the tension of the photoreceptor belt 110. In FIG. 1, reference numeral 124 represents a transfer roller for transferring the toner image formed on the photoreceptor belt 110 to a sheet of paper 126, and reference numeral 125 is a pressing roller for pressing the sheet 126 against the transfer roller 124. Also, reference numeral 150 is a drying device for removing a liquid carrier from the toner image formed by a development device to be described later.

A charging station 135 for charging the photoreceptor belt 110 is positioned in the vicinity of the carrying area of the photoreceptor belt 110 between the first and second rollers 121 and 122. In the carrying area of the photoreceptor belt 110 between the second and third rollers 122 and 123, there are alternately installed a plurality of laser scanning units (LSUs) 130 for forming a latent electrostatic image on the photosensitive region of the photoreceptor belt 110 by irradiating laser beams onto the photoreceptor belt 110, and a plurality of development devices 140 for developing the latent electrostatic image into the toner image by applying a developer liquid having a toner of a predetermined color to a region where the latent electrostatic image is formed.

The toner image of the photoreceptor belt 110 is transferred to the sheet 126 by the transfer roller 124 after being dried by the drying device 150.

Referring to FIG. 2, a development roller 141, a cleaning roller 142, and squeegee rollers 144 and 146 are disposed on the upstream side of the development device 140. The development roller 141 applies a developer liquid 148 supplied from a developer liquid supplier 143 to the latent electrostatic image formed on the photoreceptor belt 110. The cleaning roller 142 removes the excess developer liquid from the developer liquid supplier 143 which remains on the surface of the development roller 141. The squeegee rollers 144 and 146 remove excess developer liquid 148 remaining after being used in developing the latent electrostatic image. The developer liquid 148 sticking to the squeegee rollers 144 and 146 is separated by blades 145 and 147 being in contact with the surfaces of the squeegee rollers 144 and 146 to then be recovered and stored in the development device 140.

The toner image of the photoreceptor belt 110, having passed through the squeegee rollers 144 and 146, is formed into a thin-film like liquid toner image. The liquid carrier remaining in the toner image is removed while passing through a drying device 150. The drying device 150 includes a dry roller 151, a heat roller 153 and a collector 155.

The dry roller 151 absorbs the liquid carrier of the toner image while rotating in contact with the photoreceptor belt 110. An absorption layer 152 for absorbing the liquid carrier is formed on the dry roller 151. The heat roller 153 contacts the dry roller 151 and is provided with a heat source such as a halogen lamp 154. The heat roller 153 heats the surface of the dry roller 151 using the heat generated from the halogen lamp 154 to evaporate the liquid carrier absorbed into the absorption layer 152 of the dry roller 151. The collector 155 collects and recovers the gaseous carrier generated in the dry roller 151.

As described above, the conventional liquid laser printer has the following disadvantages.

First, since a dry roller heated at a high temperature directly contacts a photoreceptor belt, the life of the photoreceptor belt is shortened due to thermal stress.

Second, when the excess developer liquid is not sufficiently removed from the photoreceptor belt, the carrier may be absorbed into the dry roller excessively, which may cause contamination of the dry roller and cross contamination of the photoreceptor belt, which degrades printing quality.

Third, since the carrier sticking to the photoreceptor belt is not sufficiently evaporated by the dry roller but remains on the photoreceptor belt, the carrier recovery efficiency by the collector is lowered.

Fourth, since the toner image is maintained in a wet state due to the partially dried photoreceptor belt, the toner image is not completely transferred to the sheet of recording paper. Thus, part of the toner image remains on the photoreceptor belt as foreign matter, which considerably degrades the printing quality and contaminates internal components of the printer.

Fifth, due to the incompletely dried photoreceptor belt, the bottom surface of the photoreceptor belt, being in contact with rollers, may be contaminated by the liquid carrier. In this case, a slip occurs between the photoreceptor belt and the driving roller, which disables normal image printing.

Sixth, since the collector for collecting the evaporated gaseous carrier surrounds the dry roller and the heat roller, the overall structure is complex and bulky. Also, since the evaporated carrier contacts the heat roller while in a high temperature state, a fire may be caused in the event of overheating of the heat roller.

SUMMARY OF THE INVENTION

To solve the above problem, it is an objective of the present invention to provide a liquid electrophotographic printer having an improved drying device for drying a toner image formed on a photoreceptor belt.

Accordingly, to achieve the above objective, there is provided a liquid electrophotographic printer comprising: a photoreceptor belt circulating and supported by a plurality of rollers on an endless track; means for forming a latent electrostatic image on the photoreceptor belt; a development unit for supplying a developer liquid to the photoreceptor belt and developing the latent electrostatic image into a toner image; a drying unit for drying the photoreceptor belt on which the toner image is formed; and a transfer unit for transferring the toner image to a sheet of paper, wherein the drying unit includes: heating means installed in the vicinity of one surface of the photoreceptor belt for heating the photoreceptor belt on which the toner image is formed to evaporater a carrier sticking to the photoreceptor belt; and a collector installed in the vicinity of another surface of the photoreceptor belt for collecting the carrier evaporated by the heating means.

Therefore, the liquid electrophotographic printer according to the present invention has a simplified drying device, and the life of the photoreceptor belt is prolonged. Also, since the carrier sticking to the photoreceptor belt is sufficiently evaporated, a slip of the photoreceptor belt can be prevented.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
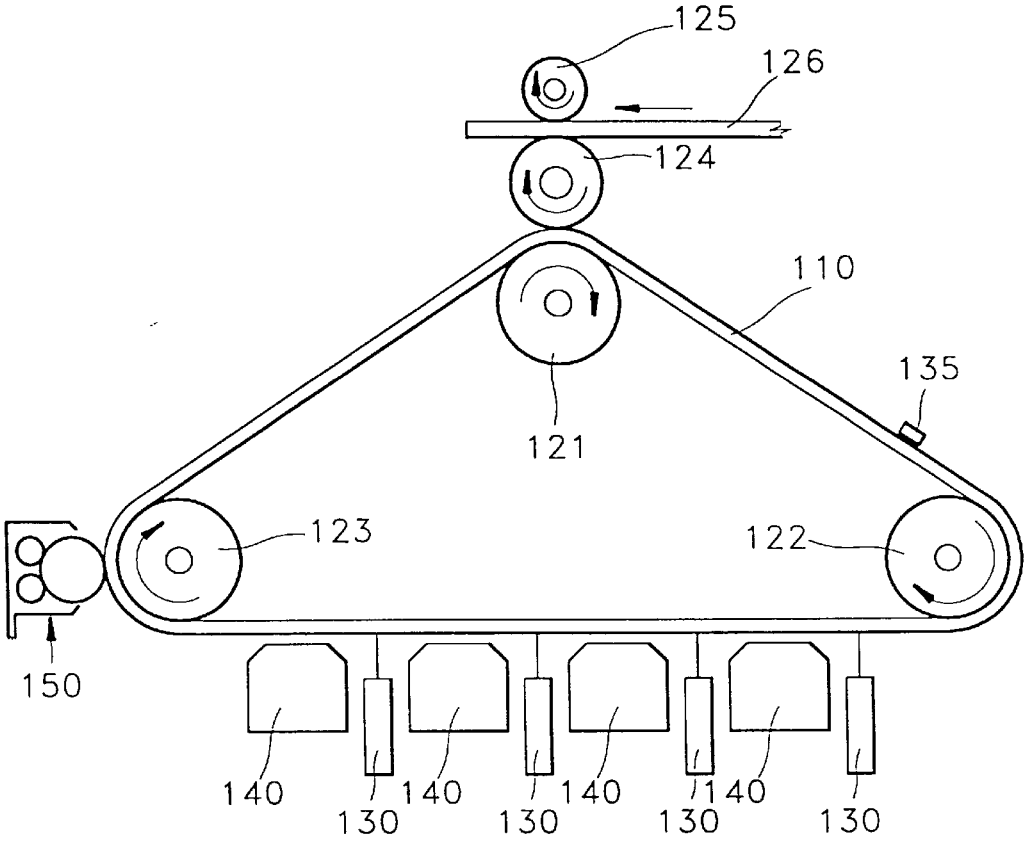
FIG. 1(PRIOR ART)
FIG. 1 is a schematic diagram illustrating important parts of a conventional liquid electrophotographic printer.
Figure 2:
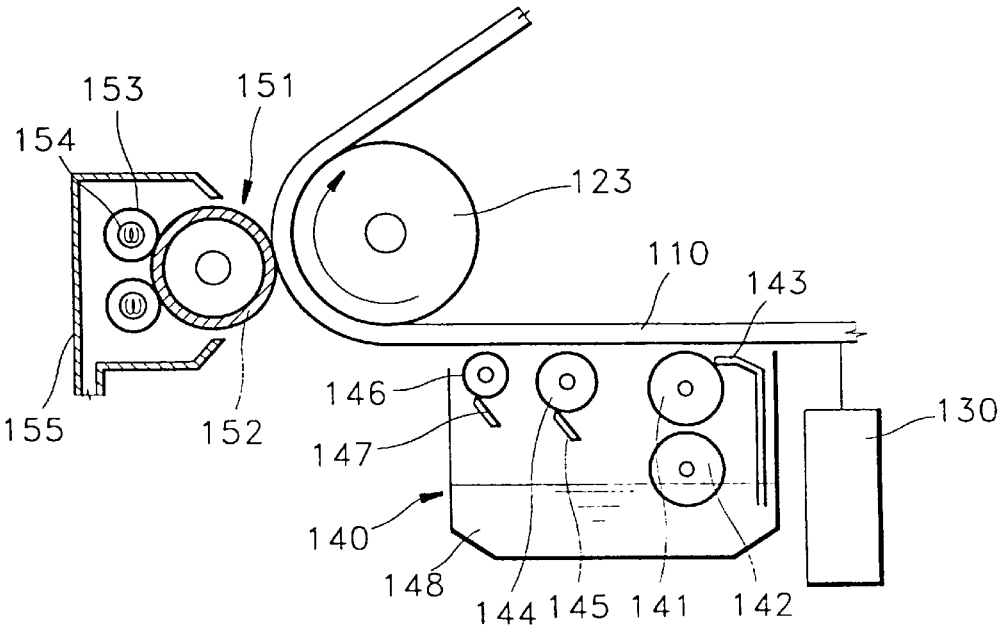
FIG. 2(PRIOR ART)
FIG. 2 is a detailed diagram illustrating a drying device and a development device of the conventional liquid electrophotographic printer shown in FIG. 1.
Figure 3:
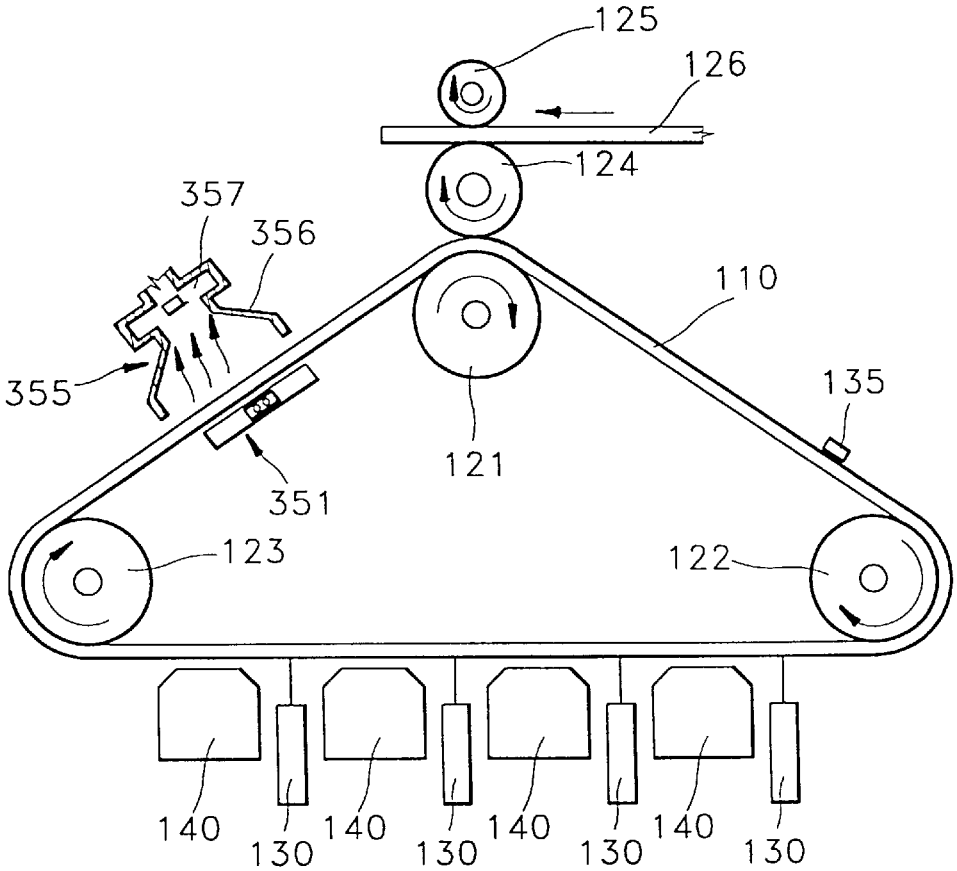
FIG. 3 is a schematic diagram of a liquid electrophotographic printer according to an embodiment of the present invention.

Referring to FIG. 3, a photoreceptor belt 110 is supported by first, second and third rollers 121, 122 and 123. The third roller 123 is a driving roller rotated by a driving motor (not shown) for rotating the photoreceptor belt 110, and the second roller 122 is a steering roller for preventing meandering by adjusting the tension of the photoreceptor belt 110.

A charging station, a development station, a drying station and a transfer station are arranged along the rotational path of the photoreceptor belt 110. A main charger 135 for uniformly charging the photoreceptor belt 110 is provided in the charging station. In the development station, there are alternately provided a plurality of laser scanning units (LSUs) 130 for scanning a laser beam onto the photoreceptor belt 110 to form a latent electrostatic image, and a plurality of development devices 140 for developing the latent electrostatic image into a toner image by applying a developer liquid to a region where the latent electrostatic image is formed.

In the development device 140, a squeegeeing means is provided for squeegeeing the photoreceptor belt 110 to which the developer liquid sticks to remove the excess developer liquid, thereby forming a thin-film like toner image containing some carrier remaining thereon. The remaining carrier is removed while the photoreceptor belt 110 on which the toner image is formed passes through the drying station to be described in detail later.

The drying station includes a heater 351 as a heat source, and a collector 355 for collecting the evaporated carrier.

Figure 4:
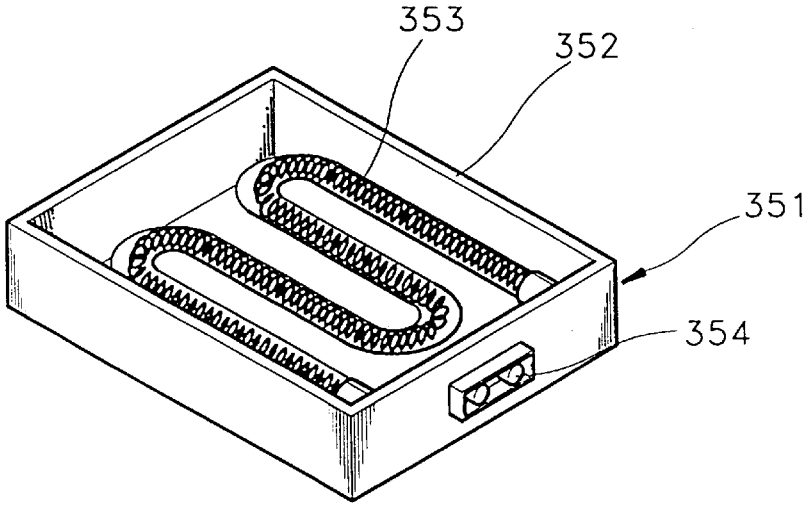
FIG. 4 is a perspective view of a heater for the liquid electrophotographic printer according to the present invention shown in FIG. 3.

The collector 355 is provided in the vicinity of the surface of the photoreceptor belt 110 on which the toner image is formed. The heater 351 is installed in the vicinity of the bottom surface of the photoreceptor belt 110. Referring to FIG. 4, the heater 351 includes a heat line 353 arranged in a plane so as to have an electric heat emitter which generates heat over a predetermined heat-emitting area, a housing 352 for accommodating the heat line 353, and a power socket 354 installed on one side of the housing 352 for supplying power to the heat line 353.

The heater 351 heats the bottom surface of the photoreceptor belt 110 and evaporates the carrier sticking to the surface of the photoreceptor belt 110. Since the heater 351 is capable of heating the photoreceptor belt 110 over an extended area of the belt, the photoreceptor belt 110 can be heated uniformly over this extended area at a low heating temperature.

Therefore, the liquid carrier can be removed efficiently. Also, since the photoreceptor belt 110 is heated at a low temperature, the life of the photoreceptor belt 110 is prolonged. Also, since the bottom surface of the photoreceptor belt 110 is exposed directly to the heater 351, the carrier on the bottom surface of the photoreceptor belt is evaporated and thus a slip between the photoreceptor belt 110 and the third roller 123, which is generated due to residual carrier on the belt, can be prevented. Also, the life of the photoreceptor belt 110 can be further prolonged and the slip can be effectively prevented by forming the rear surface of the photoreceptor belt 110 with a heat-resistive material having a great friction coefficient.

The collector 355 includes a collecting hood 356 for collecting the harmful gaseous carrier evaporated by heating the liquid carrier sticking to the photoreceptor belt 110, and a suction fan 357 installed in the collector to withdraw and collect the evaporated carrier through the collecting hood 356. The gaseous carrier collected by the suction fan 357 and the collecting hood 356 is liquefied by a separately provided liquefying device (not shown) for recycling the carrier. Since the collector 355 does not necessitate many internal components, unlike the conventional drying station, the overall structure becomes simplified. Also, since the carrier is generated at the opposite side of the heater 351, around the photoreceptor belt 110, the gaseous carrier does not contact the heater 351 and thus the dangers of a possible fire due to contact of the gaseous carrier with the heater 351 is decreased.

The toner image sufficiently dried by the drying station is then transferred to the sheet 126 by the transfer roller 124. The sheet 126 is fed between the transfer roller 124 and the pressing roller 125 in contact with the transfer roller 124 under a constant pressure. The toner image transferred to the sheet 126 is fixed onto the sheet 126 by a separate fixing means (not shown).

Figure 5:
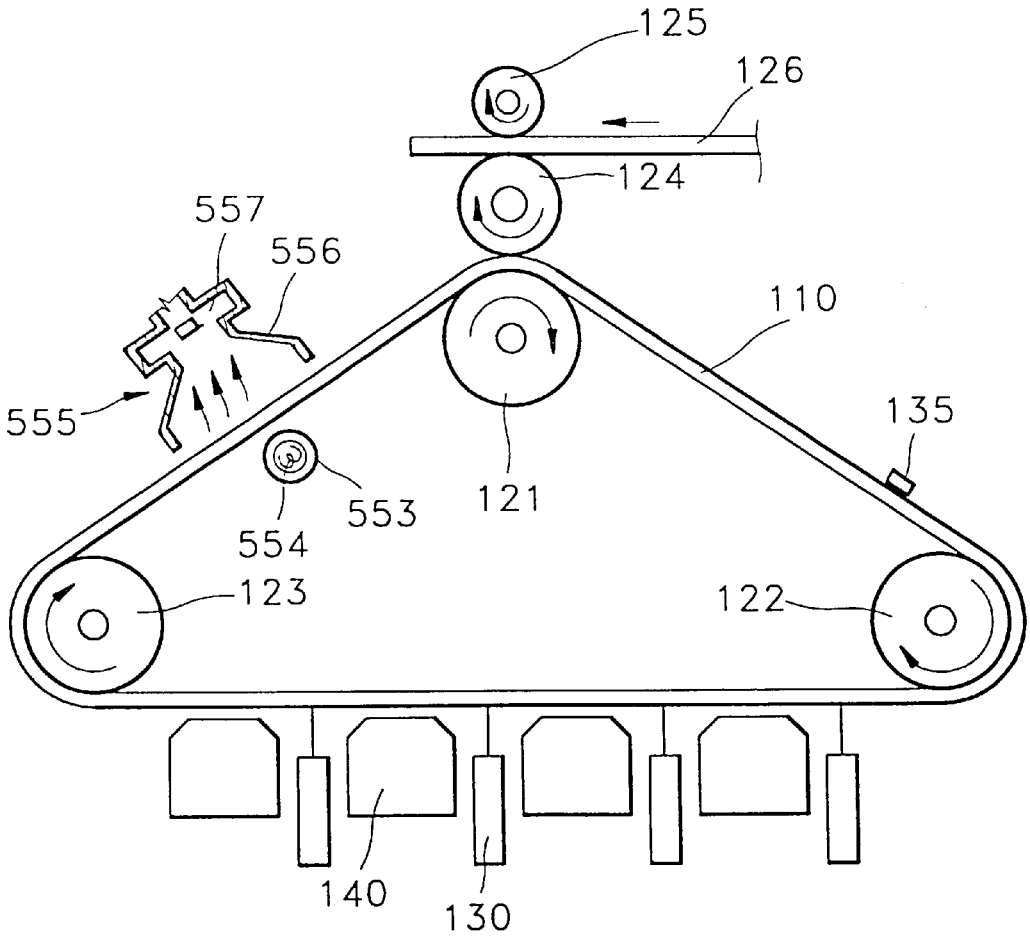
FIG. 5 is a schematic diagram of a liquid electrophotographic printer according to another embodiment of the present invention.
Figure 6:
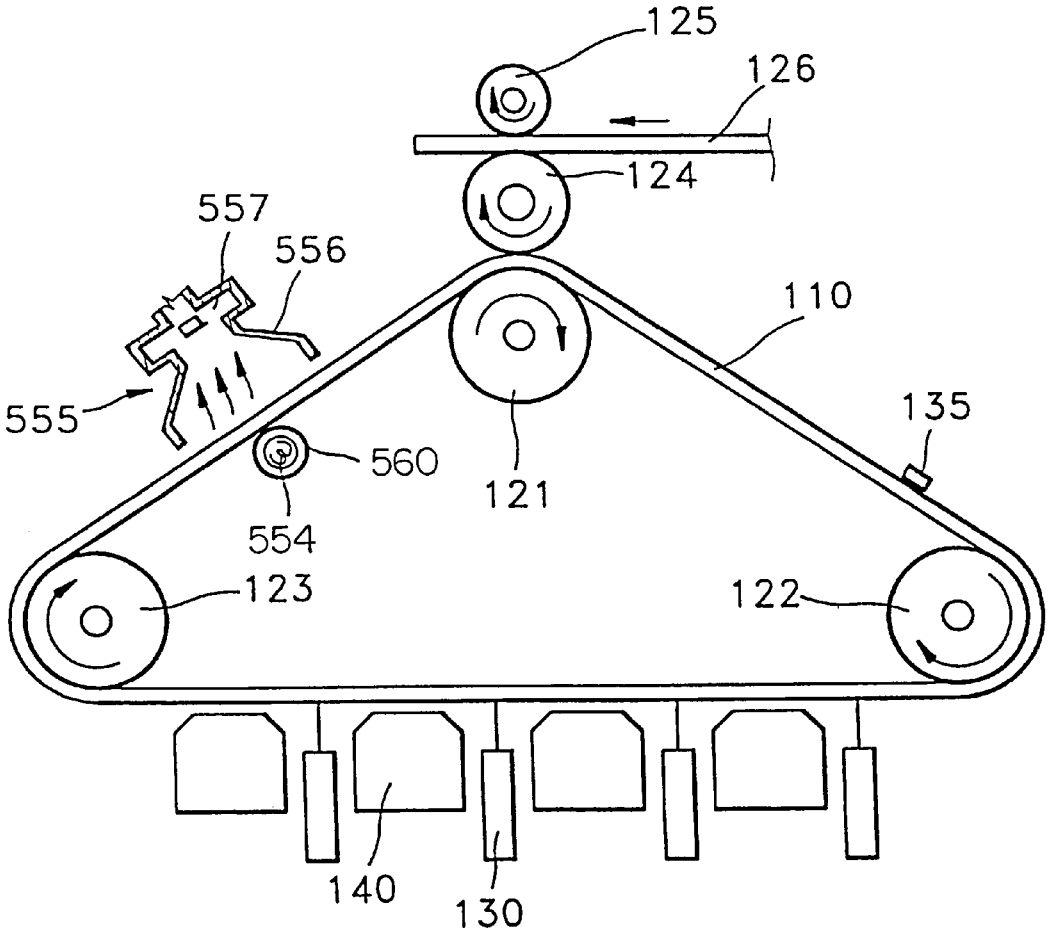
FIG. 6 is a schematic diagram of a liquid electrophotographic printer according to another embodiment of the present invention.

Referring to FIG. 5, a heat roller 553 of the drying station incorporating a halogen lamp 554 as a heat source is installed to be in contact with or spaced apart from the bottom surface of the photoreceptor belt 110 (see heat roller 560 depicted in FIG. 6 for an illustration of the embodiment in which the heat roller is in contact with the bottom surface of the photoreceptor belt 110). When the heat roller 553 contacts the photoreceptor belt 110, a pressure high enough to allow sufficient heat transmission is applied therebetween. The heat roller 553 is at least one or more in number. In the case of at least two heat rollers being installed, the respective heat rollers 553 are preferably spaced apart at a predetermined interval from one another so that the photoreceptor belt 110 is simultaneously heated over as large a surface of the belt as possible.

A collector 555 is installed over the surface of the photoreceptor belt 110, that is, the surface on which the toner image is formed, to face the heat roller 553, and has a dimension large enough to surround the area where the gaseous carrier is generated in the photoreceptor belt 110. The collector 555 includes a collecting hood 556 for collecting the harmful gaseous carrier evaporated by heating the liquid carrier sticking to the photoreceptor belt 110, and a suction fan 557 installed for withdrawing and collecting the evaporated carrier through the collecting hood 556.

As described above, the liquid electrophotographic printer according to the present invention employs a heater provided on the bottom surface of a photoreceptor belt for heating the photoreceptor belt, and a collector provided over the top surface of the photoreceptor belt. According to the present invention, since the photoreceptor belt is heated at a relatively low temperature, thermal degradation of the photoreceptor belt is reduced. Thus, the life of the photoreceptor belt is prolonged. Also, the structure of the collector is simplified. Also, since a gaseous carrier does not contact the heater directly, the danger of a fire can be reduced. Also, since the bottom surface of the photoreceptor belt is directly exposed to the heater to be dried, a slip between the photoreceptor belt and a roller can be prevented.

Having described the exemplary embodiments of the present invention, additional advantages and modifications will readily occur to those skilled in the art from consideration of the specification and practice of the invention disclosed herein. Therefore, the specification and examples should be considered exemplary only, with the true scope and spirit of the invention being indicated by the following claims.

What is claimed is:

1. A liquid electrophotographic printer comprising:

a plurality of belt rollers, a photoreceptor belt having a top surface and a bottom surface, said photoreceptor belt being supported by said plurality of belt rollers for circulating around said plurality of belt rollers on an endless track;

means for forming a latent electrostatic image on said photoreceptor belt;

a development unit for supplying a developer liquid carrier to said photoreceptor belt and for developing the latent electrostatic image into a toner image;

a drying unit for drying a portion of said photoreceptor belt where the toner image is formed; and a transfer unit for transferring the toner image to a recording sheet;

wherein said drying unit includes:

heating means installed near one of the top and bottom surfaces of said photoreceptor belt for heating the portion of said photoreceptor belt where the toner image is formed so as to evaporate a remaining developer liquid carrier sticking to the portion of said photoreceptor belt; and a collector installed near the other of the top and bottom surfaces of said photoreceptor belt for collecting the remaining liquid developer carrier evaporated by said heating means.

2. The liquid electrophotographic printer according to claim 1, wherein said heating means is a heater having an electric heat line.

3. The liquid electrophotographic printer according to claim 2, wherein said heating means is arranged in a plane so that said heating means simultaneously heats a length of said photoreceptor belt substantially equal to a length of said plane in which said heating means is arranged.

4. The liquid electrophotographic printer according to claim 1, wherein said heating means comprises at least one heat roller having a heat source.

5. The liquid electrophotographic printer according to claim 4, wherein said at least one heat roller contacts the bottom surface of said photoreceptor belt under a constant pressure.

6. The liquid electrophotographic printer according to one of claims 1 through 4, wherein said heating means is provided to be spaced apart from the bottom surface of said photoreceptor belt.

7. The liquid electrophotographic printer according to claim 1, wherein the latent electrostatic image is formed on the top surface of said photoreceptor belt; and wherein said heating means faces the bottom surface of said photoreceptor belt, and said collector faces the top surface of said photoreceptor belt.

8. The liquid electrophotographic printer according to claim 1, wherein said collector includes a suction device installed therein to withdraw the evaporated carrier.

9. The liquid electrophotographic printer according to claim 8, wherein said suction device is a fan.

* * * * *